US008480255B2

(12) United States Patent
Sim

(10) Patent No.: US 8,480,255 B2
(45) Date of Patent: Jul. 9, 2013

(54) LIGHT EMITTING DIODE (LED) LAMP

(76) Inventor: Boon Hiong Sim, Singapore (SG)

( * ) Notice: Subject to any disclaimer, the term of this patent is extended or adjusted under 35 U.S.C. 154(b) by 105 days.

(21) Appl. No.: 13/259,193

(22) PCT Filed: May 28, 2009

(86) PCT No.: PCT/SG2009/000189
§ 371 (c)(1),
(2), (4) Date: Sep. 23, 2011

(87) PCT Pub. No.: WO2010/138078
PCT Pub. Date: Dec. 2, 2010

(65) Prior Publication Data
US 2012/0113635 A1 May 10, 2012

(51) Int. Cl.
*F21V 21/00* (2006.01)

(52) U.S. Cl.
USPC ..... 362/249.02; 362/294; 362/541; 362/545; 362/547

(58) Field of Classification Search
USPC ..... 362/249.02, 294, 545, 541, 547
See application file for complete search history.

(56) References Cited

U.S. PATENT DOCUMENTS

| | | | | |
|---|---|---|---|---|
| 5,160,201 | A * | 11/1992 | Wrobel | 362/249.03 |
| 7,040,790 | B2 * | 5/2006 | Lodhie et al. | 362/541 |
| 7,347,586 | B2 | 3/2008 | Izardel | 362/247 |
| 7,663,229 | B2 * | 2/2010 | Lu et al. | 257/712 |
| 8,251,543 | B2 * | 8/2012 | Bauer | 362/249.11 |
| 2005/0265039 | A1 | 12/2005 | Lodhie et al. | 362/541 |
| 2006/0250792 | A1 | 11/2006 | Izardel | 362/231 |

FOREIGN PATENT DOCUMENTS

WO WO2008031281 A1 3/2008

* cited by examiner

*Primary Examiner* — Ali Alavi
(74) *Attorney, Agent, or Firm* — Walter J. Tencza, Jr.

(57) ABSTRACT

A light emitting diode (LED) lamp and socket system is disclosed. The lamp comprises a first pair of side connecting pins adapted to provide electrical input to at least one LED, the first pair of side connecting pins positioned at an angle from one another such that the angle between the first pair of side connecting pins is defined from the horizontal cross-sectional center of the lamp and the first pair of side connecting pins protrudes outwards from the lamp. The socket is adapted for receiving a LED lamp partially therein, it comprises a base portion adapted to secure at least one pair of side connecting pins of the LED lamp and a top portion adapted for receiving at least one pair of electrical wires, such that when the base portion and top portion are connected, each of the at least one pair of side connecting pins electrically contacts an electrical wire and thereby provides electrical input to the LED lamp.

20 Claims, 9 Drawing Sheets

2 pin type

LIGHT EMITTING DIODE (LED) LAMP

FIELD OF THE INVENTION

The present invention relates to light emitting diodes (LED) lamps. The invention is particularly suited, but not limited to LED lamps having electrical power consumption of at least one wattage.

BACKGROUND TO THE INVENTION

The following discussion of the background of the invention is intended to facilitate an understanding of the present invention. However, it should be appreciated that the discussion is not an acknowledgement or admission that any of the material referred to was published, known or part of the common general knowledge in any jurisdiction as at the priority date of the application.

Current LED lamps generally have to be adapted to conform to traditional lamp fitting standards such as MR-16, E27 and/or GU-10 because these fitting standards are often not suitably adapted for the electrical polarity required for LED. One way to adapt a LED lamp to a traditional fitting standard is to integrate the LED lamp system design by incorporating its own fixture design, lens system, driver circuitry and transformer circuitry etc. However, when any of the mentioned components breaks down, the whole lamp invariably has to be replaced due to its integrated design. This results in unnecessary wastage and increase the overall cost of replacing the LED lamps.

Due to the comparatively lower heat tolerance compared to traditional lamps, additional heat-sinks and/or other heat dissipation devices are often required to be separately attached to the LED lamps during fitting to dissipate heat and preserve the life-span of the LEDs. It has been noted by the applicant that the electrical conducting portion of the traditional fitting standard is typically positioned at an end of the LED lamp opposite the lamp head. Such positioning meant that the heat dissipation devices have to be attached to other portions of the LED lamps instead. However, when the heat dissipation devices are attached to other portions of the LED lamps, the heat dissipation device is likely to be obstructed by other components required during fitting. This may limit the heat dissipating capability of the heat dissipation devices due to the restricted air flow caused by the above mentioned obstruction. In addition, attaching the heat dissipation devices to these other portions may result in irregularity in the overall shape of the lamp, hence requiring the corresponding socket and fitting mechanisms to be adapted to suit such irregularity.

Another problem which may arise is the fact that a user typically is not able to distinguish between the electrical inputs required for different LED lamps easily. Often, they have to rely and read the electrical specification manual in order to ensure that the right type of LED lamp is matched with the right electrical input. Carelessness on the part of the user may compromise safety, causing hurt to the user and damage to the LED lamp.

It is thus an object of the invention to overcome, or at least ameliorate in part, one or more of the aforementioned problems.

SUMMARY OF THE INVENTION

Throughout this document, unless otherwise indicated to the contrary, the phrase "comprising", "consisting of", and the like, are to be construed as inclusive and not exhaustive.

In accordance with a first aspect of the present invention there is a light emitting diode (LED) lamp, the lamp comprising a first pair of side connecting pins adapted to provide electrical input to at least one LED, the first pair of side connecting pins positioned at an angle from one another such that the angle between the first pair of side connecting pins is defined from the horizontal cross-sectional center of the lamp and the first pair of side connecting pins protrudes outwards from the lamp.

Preferably, when the electrical input is a constant current input, the angle between the first pair of side connecting pins is 150 degrees.

Preferably, when the electrical input is a constant voltage input, the angle between the first pair of side connecting pins is 165 degrees.

Preferably, when the electrical input is an alternating current input, the angle between the first pair of side connecting pins is 180 degrees.

Preferably, when the at least one LED source is a bi-color LED, the lamp further comprises a second pair of side connecting pins.

Preferably, when the at least one LED source is a RGB LED, the lamp further comprises a second and third pair of side connecting pins.

Preferably, the side connecting pins are arranged such that each side connecting pin has a different polarity with respect to its adjacent side connecting pin.

Preferably, the lamp further comprises a printed circuit board (PCB), the PCB configured to connect each side connecting pin to the LED. Preferably, the PCB regulates the electrical input to control the brightness and electrical power supplied to the LED.

Preferably, a heat sink is attached to the lamp such that the overall shape of the lamp is cylindrical. Preferably, the heat sink has the same diameter as the lamp.

Preferably, the lamp includes a reflector and lamp head cover.

Preferably, each side connecting pin is positioned at the angle of at least thirty degrees from any other side connecting pin.

In accordance with a second aspect of the invention there is a socket adapted for receiving a LED lamp partially therein, the socket comprising a base portion, the base portion adapted to secure at least one pair of side connecting pins of the LED lamp at a first angle as defined from the horizontal cross-sectional center of the base portion; and a top portion, the top portion adapted for receiving at least one pair of electrical wires; such that when the base portion and top portion are connected, each of the at least one pair of side connecting pins contacts an electrical wire and thereby provides electrical input to the LED lamp.

Preferably, the at least one pair of electrical wires are arranged such that when connected, each electrical wire supplies electricity of a different polarity with respect to its adjacent electrical wires.

Preferably, when the electrical input is a constant current input, the first angle is 150 degrees.

Preferably, when the electrical input is a constant voltage input, the first angle is 165 degrees.

Preferably, when the electrical input is an alternating current input, the first angle is 180 degrees.

In accordance with a third aspect of the invention there is a LED lamp system, the system comprising a socket as defined in the second aspect of the invention; and a LED lamp as defined in the first aspect of the invention, where the LED lamp is partially received in the socket such that electrical input provided by the at least one pair of electrical wires is supplied to the LED lamp by way of the at least one pair of side connecting pins.

BRIEF DESCRIPTION OF THE DRAWINGS

The following invention will be described with reference to the accompanying drawings of which.

Other arrangements of the invention are possible and, consequently, the accompanying drawings are not to be understood as superseding the generality of the preceding description of the invention.

DETAILED DESCRIPTION OF THE INVENTION

Figure 1:
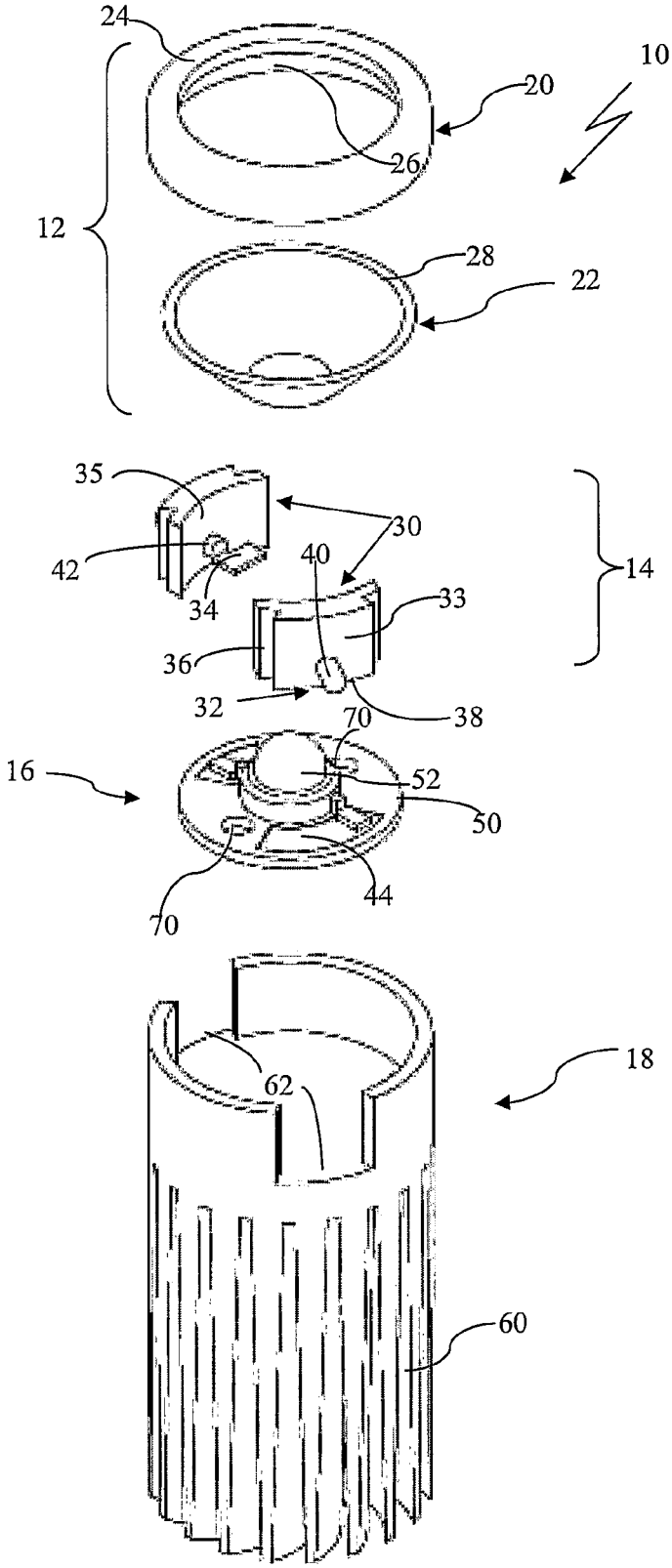
FIG. 1 is the isometric view of the parts of a LED lamp according to the embodiment of the present invention.

In accordance with an embodiment of the invention there is a LED lamp 10. The embodiment comprises a lamp head assembly 12, two side connecting pin modules 14, a LED assembly 16 and a heat sink 18 as shown in FIG. 1.

Figure 3A:
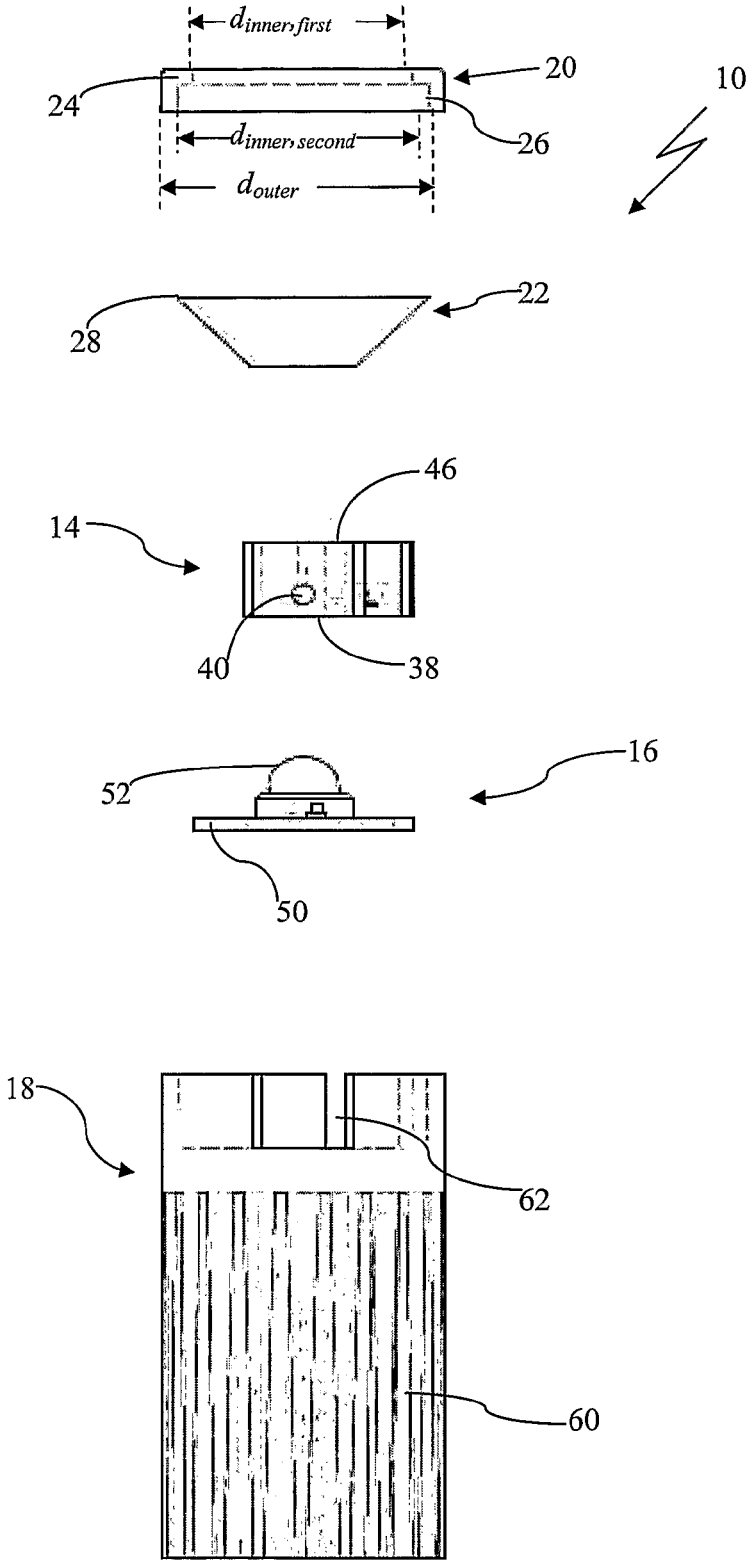
FIG. 3*a* is the side view of the parts of a LED lamp according to the embodiment of the present invention.

The lamp head assembly 12 comprises a lamp head holder 20 and a reflector 22. The lamp head holder 20 is a circular cap comprising a first ring 24 and a second ring 26. The first ring 24 and second ring 26 are integrally moulded to form the lamp head holder 20. The first ring 24 and second ring 26 are co-centric and share the same outer diameter $d_{outer}$ (see FIG. 3*a*). The first ring 24 and second ring 26 differs in their inner diameter such that the inner diameter $d_{inner,first}$ of the first ring 24 is smaller than the inner diameter $d_{inner,second}$ of the second ring 26 as shown in FIG. 3*a*.

The reflector 22 is a circular conical frustum. A base portion 28 of the reflector 22 is sized and shaped to fit within the lamp head holder 20. The base portion 28 of the reflector 22 has the largest diameter relative to the whole reflector 22. A portion of the reflector 22 with the smallest diameter is sized and shaped to receive a surface mounted LED 52. The diameter of the base portion 28 is slightly smaller or equal to the inner diameter $d_{inner,second}$ of the second ring 26, but is larger than the inner diameter $d_{inner,first}$ of the first ring 24.

Each side connecting pin module 14 comprises a curved rectangular base 30, a side connecting pin 32 and an electrical conducting plate 34. The curved rectangular base 30 has two extension flaps 36 integrally moulded with it. Each extension flap 36 has a smaller thickness than the curved rectangular base 30. The two extension flap 36 extends outwards from two opposite ends of the curved rectangular base 30 respectively. The two opposite ends are perpendicular to a lower end 38 of the curved rectangular base 30. The two opposite ends are substantially parallel to each other. Side connecting pin 32 is positioned proximate the lower end 38 of the curved rectangular base 30. A first portion 40 of the side connecting pin 32 extends substantially perpendicular from an outer convex surface 33 of the curved rectangular base 30. A second portion 42 of the side connecting pin 32 extends substantially perpendicular from an inner concave surface 35 of the curved rectangular base 30. The first portion 40 of the side connecting pin 32 is longer than that of the second portion 42. Side connecting pin 32 is made of an electrical conducting material such as copper.

The electrical conducting plate 34 extends contiguously from the second portion 42 of the side connecting pin 32. Each electrical conducting plate 34 is oriented, when assembled, such that its largest surface contacts a printed circuit board (PCB) 50 via solder pads 44.

The LED assembly 16 comprises PCB 50 and a surface mounted LED 52 mounted thereon. The surface mounted LED 52 is typically a high power surface mounted LED commonly available in the market. The PCB 50 is configured to connect the side connecting pins 32 and surface mounted LED 52. The PCB may be further configured to regulate electrical input to the surface mounted LED 52. This regulation allows for some control to be exercised over the brightness of the surface mounted LED 52. As the means by which the PCB 50 regulates electrical input to the surface mounted LED 52 would be well known to the person skilled in the art it will not be further described herein.

The heat sink 18 comprises a plurality of fins 60 and two slots 62. Fins 60 are shaped and sized to increase the surface area of the heat sink 18 for heat dissipation. Each of the two slots 62 are sized and adapted to receive a side connecting pin module 14. The overall shape of the heat sink 18 in this embodiment is cylindrical.

The embodiment is next described in the context of manufacturing the LED lamp 10.

The PCB 50 and the surface mounted LED 52 are first fitted onto the heat sink 18 using two securing screws (not shown). Two holes 70 are sized and shaped to receive the two securing screws. Thermal contact between the PCB 50 and the heat sink 18 is ensured by applying a heat sink compound as known to a person skilled in the art. The heat sink compound provides a thermal contact for the heat sink 18 to dissipate heat away from the PCB 50.

The side connecting pin modules 14 are fitted within slots 62 of the heat sink 18. Each side connecting pin modules 14, when so fitted is positioned such that:

(i) the two extension flaps 36 lie snugly on the inner curved surface of the heat sink 18;

(ii) the outer convex surface 33 of the side connecting pin module 14 sits flush with the outer curved surface of the heat sink 18; and (iii) An end 46 opposite the lower end 38 of side connecting pin modules 14 flushes with the non-fin end of heat sink 18.

The electrical conducting plates 34 of the side connecting pin module 14 are then soldered onto the PCB 50.

Figure 3B:
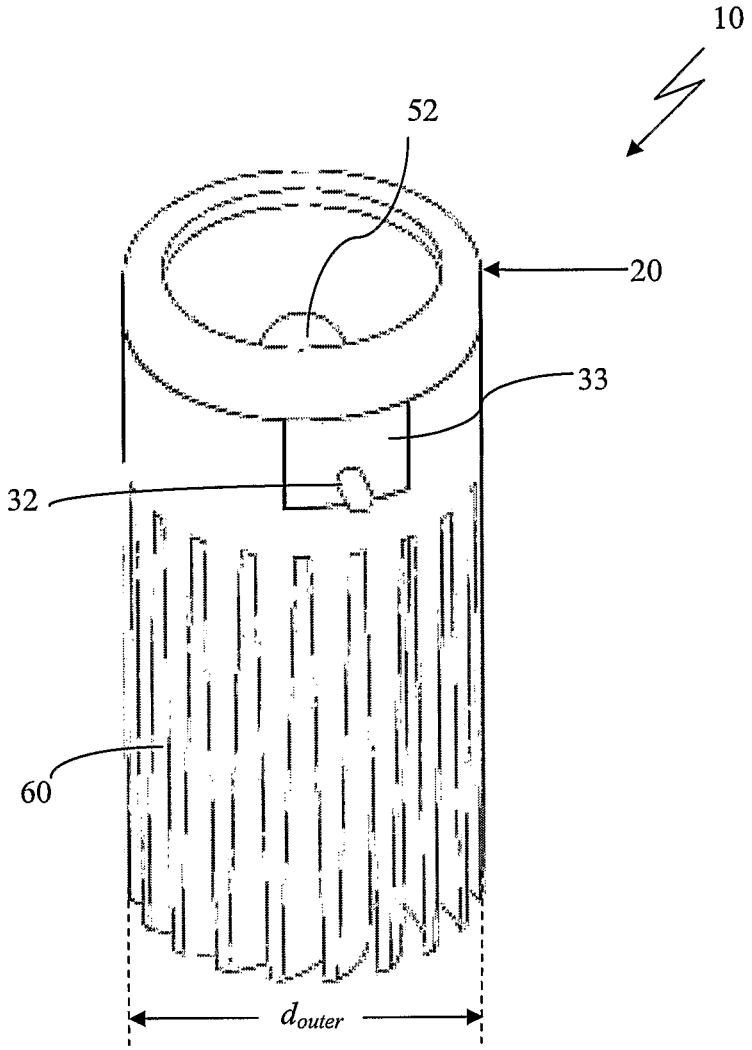
FIG. 3*b* is the isometric view of the assembled LED lamp according to the embodiment of the present invention.

The smallest diameter end of the reflector 22 is positioned on the surface mounted LED 52. The lamp head holder 20 is then positioned on top of the reflector 22 such that the base portion 28 contacts the first ring 24. The isometric view of the fully assembled LED lamp 10 is shown in FIG. 3*b*.

The various components of the LED lamp 10 are then sealed together with methods known to a person skilled in the art.

Figure 2:
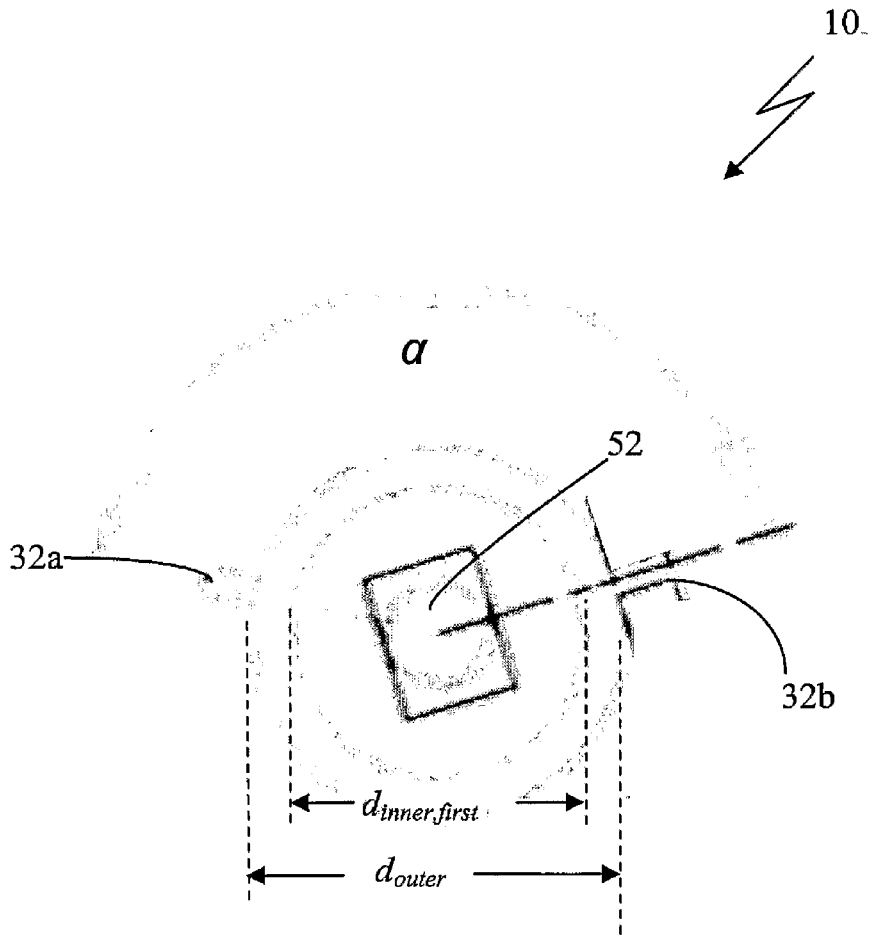
FIG. 2 is the top view of the LED lamp shown in FIG. 1 according to the embodiment of the present invention.

When viewed from the top as seen in FIG. 2, when the side connecting pins 32 are angled to form an upright 'V', the first side connecting pin 32*a* is of negative polarity and the second side connecting pin 32*b* is of positive polarity.

Figure 4A:
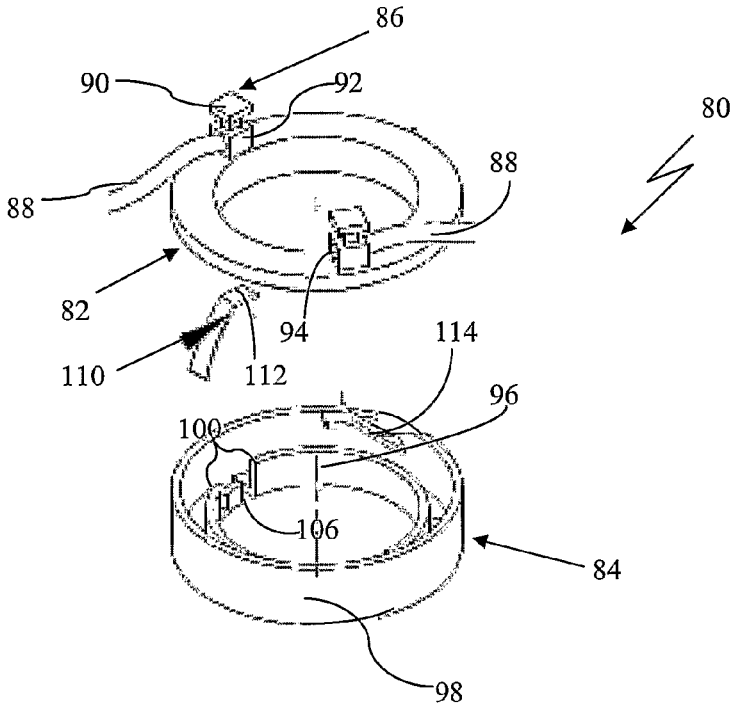
FIG. 4*a* is the isometric view of a socket adapted for fitting the embodiment of the invention.
Figure 4B:
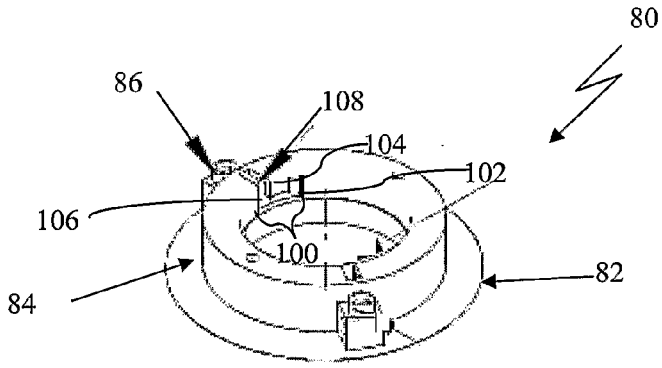
FIG. 4*b* is the isometric view of an alternative socket to FIG. 4*a*.
Figure 4C:
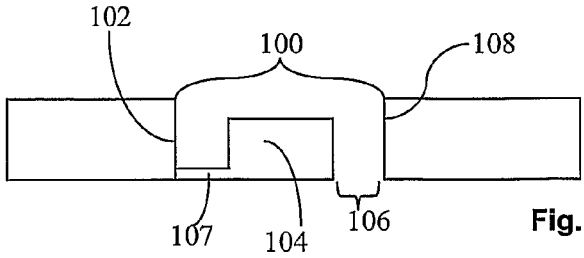
FIG. 4*c* is the close-up side profile view of an opening for receiving a side connecting pin of the LED lamp.
Figure 5A:
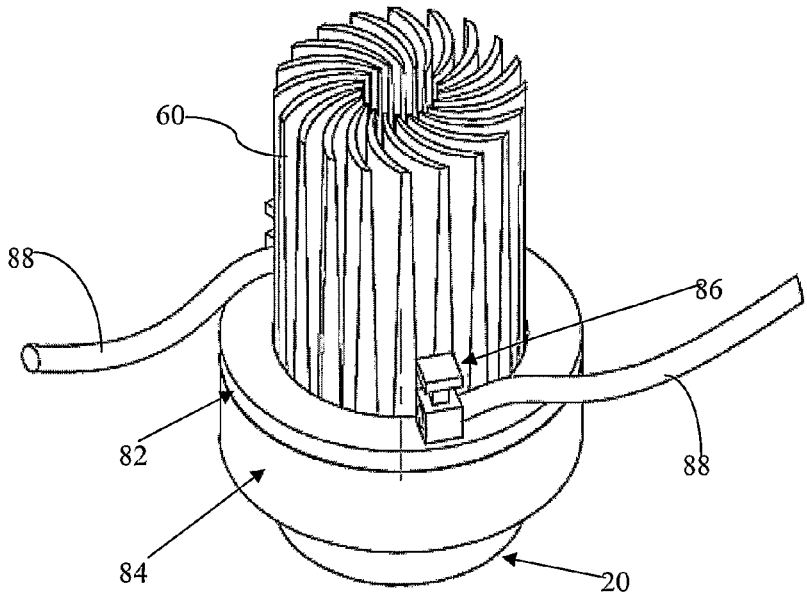
FIG. 5*a* and FIG. 5*b* are the isometric views of the LED lamp attached to the socket in FIG. 4*a* according to the embodiment of the present invention.
Figure 5B:
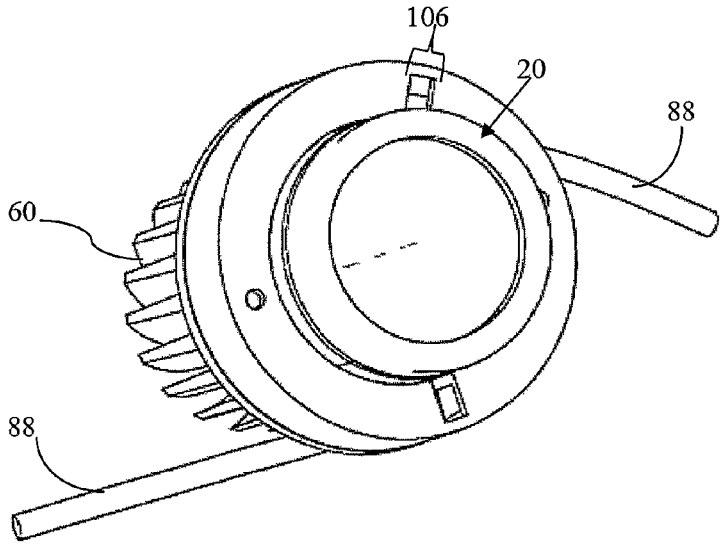

Upon assembly, the LED lamp 10 is attached onto a socket 80 as shown in FIG. 4. The parts of the socket 80 are described as follows.

The socket 80 comprises a socket top plate 82 and a socket base 84. Two wire holders 86 are positioned on the socket top 82. Each wire holder 86 further comprises a spring loaded connector 90 and a square block 92. The square block 92 has a hole 94 adapted to receive wires 88. When the spring loaded connector 90 is pushed downwards, the hole 94 on the square block 92 is unblocked to allow an exposed (un-insulated) end of wire 88 to be slotted into the hole 94. Upon releasing the spring loaded connector 90, hole 94 is blocked; the spring loaded connector 90 exerts a force against the exposed end of wire 88, securing the exposed end of wire 88 such that the exposed end of wire 88 contacts the square block 92 and is prevented from moving out of the square block 92.

The socket base 84 is adapted to receive the two side connecting pins 32. The socket base 84 comprises an inner circular portion 96 and a co-centric outer circular portion 98. The inner circular portion 96 has two openings 100. The two openings 100 are adapted to receive the two side connecting pins 32. An angle α between the two openings 100, as taken from the centre of the inner circular portion 96, will be described in more detail below. The centre of the inner circular portion 96 corresponds to the LED lamp 10.

Extended from one end 102 of each opening 100 is a flap 104. A gap 106 between the flap 104 and another end 108 is sized to receive a side connecting pin 32.

Two connector springs 110 provides electrical connection between the two wires 88 and the side connecting pins 32. For each connector spring 110, a first end 112 contacts the exposed end of the wire 88. A second end 114 of the connector spring 110 is adapted to contact the side connecting pin 32. The first end 112 of the connector spring 110 is connected to its corresponding square block 92 via rivets (not shown). The first end 112 is shorter than the second end 114.

When a side connecting pin 32 is pushed into the gap 106 between the flap 104 and end 108, the side connecting pin 32 contacts the connector spring 110. As the side connecting pin 32 is pushed into the gap, the connector spring 110 exert a force pushing the side connecting pin 32 in a direction opposite the direction of entry. Upon rotating the LED lamp 10 in a direction away from end 108, the side connecting pin 32 is moved away from end 108 along the edge of the flap 104 towards end 102 until it rests on a connecting portion 107. At this position, the LED lamp 10 is attached to the socket 80. It is to be appreciated that throughout the movement of the side connecting pin 32, the connector spring 110 contacts the side connecting pin 32 and continues to maintain contact with the side connecting pin 32 when it rests on the connecting portion 107.

Figure 6A:
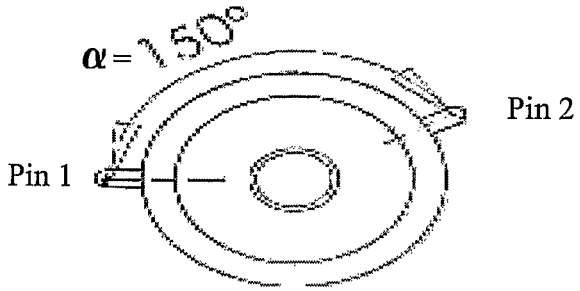
FIGS. 6*a* to 6*c* are the top views of the LED lamp shown in FIG. 1 according to the two side connecting pin configuration of the present invention.

Depending on the type of electrical input, the angle α between the two side connecting pins 32 is adjusted accordingly. The type of electrical input and the corresponding angle between the two side connecting pins modules 14 are presented in FIG. 6*a* to FIG. 6*c* and are described as follows:

(a) When the electrical input is a constant DC current input, the angle α between the two side connecting pin modules 14, i.e. between side connecting pin 1 and side connecting pin 2 is 150 degrees as shown in FIG. 6*a*

Figure 6B:
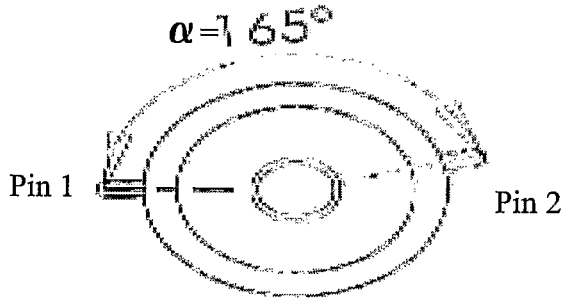

(b) When the electrical input is a constant DC voltage input, the angle α between the two side connecting pin modules 14, i.e. between side connecting pin 1 and side connecting pin 2 is 165 degrees as shown in FIG. 6*b*.

Figure 6C:
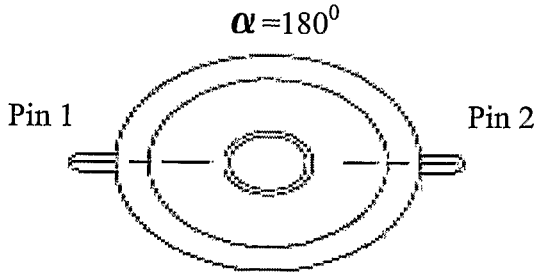

(c) When the electrical input is an alternating current AC input, the angle α between the two side connecting pin modules 14, i.e. between side connecting pin 1 and side connecting pin 2 is 180 degrees as shown in FIG. 6*c*.

The present embodiment may be further modified to suit different types of LEDs 52.

Figure 7A:
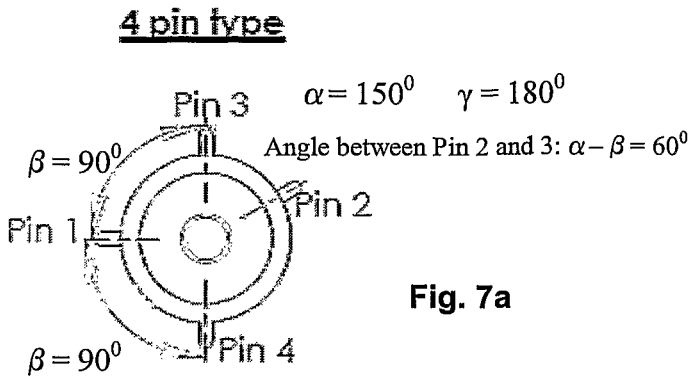
FIGS. 7*a* and 7*b* are the top views of the LED lamp shown in FIG. 1 according to an alternative four side connecting pin configuration of the present invention adapted for holding bi-color LEDs.
Figure 7B:
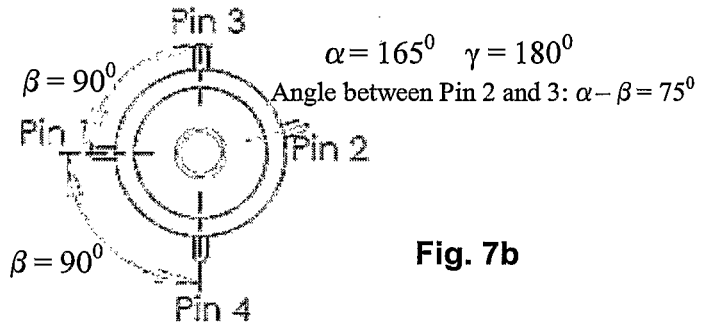

For example, four side connecting pin modules 14 are used for providing electrical input to a bi-color LED as presented in FIG. 7*a* and FIG. 7*b*. The socket 80 is modified to match the additional side connecting pins 32 by having four openings 100 and four wire holders 86. The heat sink 18 is modified to have four slots 62. The respective angles α, β, γ, r between each of the four side connecting pin 32 are then defined as follows:

(a) When the electrical input is a constant DC current input, the angle α between side connecting pin 1 and side connecting pin 2 is 150 degrees; the angle β between side connecting pin 1 and side connecting pin 3/side connecting pin 4 is 90 degrees; and the angle γ between side connecting pin 3 and side connecting pin 4 is 180 degrees as shown in FIG. 7*a*.

(b) When the electrical input is a constant DC voltage input, the angle α between side connecting pin 1 and side connecting pin 2 is 165 degrees; the angle β between side connecting pin 1 and side connecting pin 3/side connecting pin 4 is 90 degrees; and the angle γ between side connecting pin 3 and side connecting pin 4 is 180 degrees as shown in FIG. 7*b*.

Figure 8A:
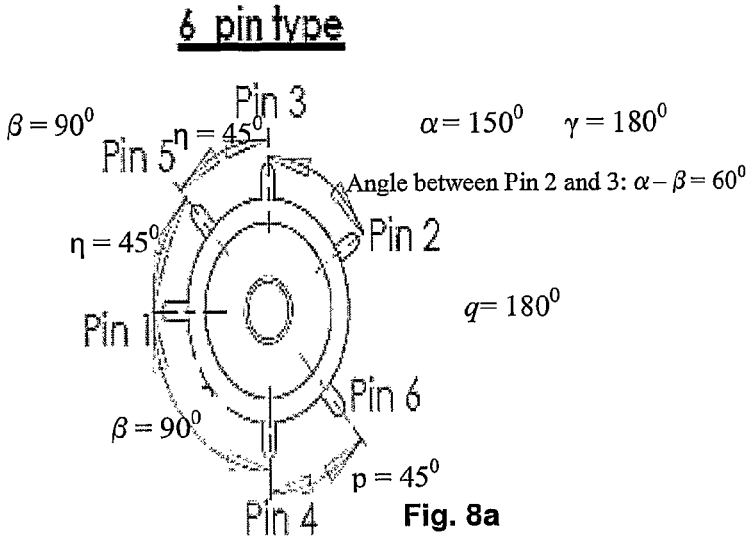
FIGS. 8*a* and 8*b* are the top views of the LED lamp shown in FIG. 1 according to an alternative six side connecting pin configuration of the present invention adapted for holding RGB LEDs.
Figure 8B:
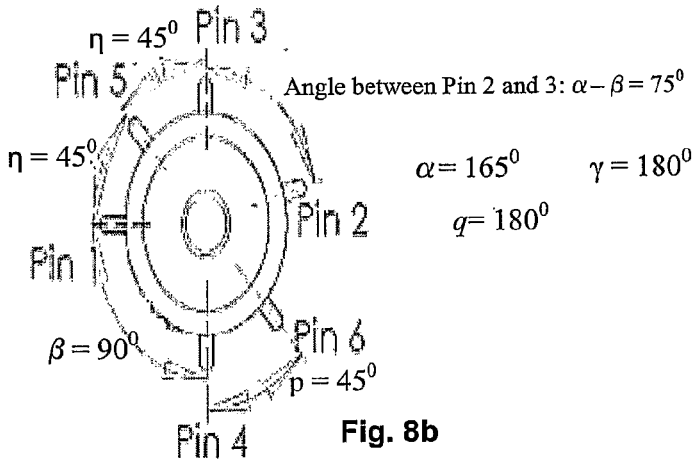

As another example, six side connecting pin modules 14 are used for providing electrical input to a RGB LED as presented in FIG. 8*a* and FIG. 8*b*. The socket 80 is modified to match the additional side connecting pins by having six openings 100 and six wire holders 86. The heat sink 18 is modified to have six slots 62. The respective angles α, β, γ, η, p, q between each side connecting pin 32 are defined as follows:

(a) When the electrical input is a constant DC current input, the angle α between side connecting pin 1 and side connecting pin 2 is 150 degrees, the angle β between side connecting pin 1 and side connecting pin 3/side connecting pin 4 is 90 degrees; the angle γ between side connecting pin 3 and side connecting pin 4 is 180 degrees; the angle η between side connecting pin 1/side connecting pin 3 and side connecting pin 5 is 45 degrees; the angle p between side connecting pin 4 and side connecting 6 is 45 degrees; and the angle q between side connecting pin 5 and side connecting pin 6 is 180 degrees as shown in FIG. 8*a*.

(b) When the electrical input is a constant DC voltage input, the angle α between side connecting pin 1 and side connecting pin 2 is 165 degrees; the angle β between side connecting pin 1 and side connecting pin 3/side connecting pin 4 is 90 degrees; the angle γ between side connecting pin 3 and side connecting pin 4 is 180 degrees; the angle η between side connecting pin 1/side connecting pin 3 and side connecting pin 5 is 45 degrees; the angle p between side connecting pin 4 and side connecting pin 6 is 45 degrees; and the angle q between side connecting pin 5 and side connecting pin 6 is 180 degrees as shown in FIG. 8*b*.

Unless stated to the contrary, all defined angles (α, β, γ, η, p, q) refer to the angle as taken from the centre of the LED lamp 10, as per angle α.

The above examples ensures that the right type of socket is fitted with the right number of side connecting pins, with the additional differentiating factor of different angles between the side connecting pins corresponding to different type of electrical input. Hence, while satisfying the electrical input requirements, the arrangement of the side connecting pins also eliminates errors on the part of a user fitting the LED lamp 10, thus enhances safety. In addition, the positioning of the side connecting pins 32 extending from the side of the LED lamp 10 near the lamp head assembly 12 enables the heat sink 18 to be directly attached to the LED assembly 16 without obstructing the socket 80 during fitting.

The similar outer diameter $d_{outer}$ of the heat sink 18 and the LED lamp 10 achieves a regular cylindrical design when they are integrated, thus promoting easy fitting using regular tools.

In addition, the current LED lamp 10 is kept independent from the other components such as the transformer circuitry. Should the LED lamp 10 spoils, the LED lamp 10 may be isolated from the other components and replaced without the need to replace other components, thereby reducing costs.

An alternative socket 80, where like numerals reference like parts, is illustrated in FIG. 4*b*. The alternative socket 80 provides a different direction of entry for the LED lamp 10 during fitting. The alternative socket 80 has its two wire holders 86 positioned on a socket top 82 but at the other end in respect to the socket 80 described earlier. Each wire holder 86 is adapted to receive wires 88 similar to that described earlier.

Similar to the fitting process described earlier, when a side connecting pin 32 is pushed between the flap 104 and end 108, the side connecting pin 32 contacts the connector spring 110 (not shown). Upon rotating the LED lamp 10 in a direction away from end 108, the side connecting pin 32 is moved away from end 108 along the edge of the flap 104 towards end 102 until it rests on a connecting portion 107. At this position, the LED lamp 10 is attached to the socket 80.

It should be appreciated by the person skilled in the art that the invention is not limited to the examples described. In particular, the following additions and/or modifications can be made without departing from the scope of the invention:

The first ring 24 may be covered with a circular transparent covering as part of the water proofing feature for the LED lamp 10.

The PCB 50 may be further adapted to hold multiple surface mounted LEDs 52 as would be known to a person skilled in the art. The lamp head holder 20 may be replaceable by that known to a person skilled in the art. Typically, they may be a sealed, threaded or clip type.

The LED 52 need not be surface mounted. As an alternative, the LED 52 may be attached to a LED holder, and the LED holder shaped and sized to receive a LED 52, or a plurality of LEDs 52.

The lamp head assembly 12 may be replaced by focusing lens, diffuser or bulb head diffuser etc. for different lighting requirements and applications as known to a person skilled in the art.

The side connecting pin module 14 may be integrally moulded with the lamp head assembly 12. The lamp head assembly 12 is then attached to heat sink 18 via any commonly known securing mechanism e.g. clipping, or groove-flange mechanism as known to a person skilled in the art. In this case slots 62 on the heat sink are no longer required.

It should be further appreciated by the person skilled in the art that features and modifications discussed above, not being alternatives or substitutes, can be combined to form yet other embodiments that fall within the scope of the invention described.

The invention claimed is:

1. A light emitting diode (LED) lamp, the lamp comprising one or more LEDs;

a first pair of side connecting pins adapted to provide an electrical input to at least one LED of the one or more LEDs, the first pair of side connecting pins positioned at an angle from one another such that the angle between the first pair of side connecting pins is defined from a horizontal cross-sectional center of the light emitting diode lamp and the first pair of side connecting pins protrudes outwards from the light emitting diode lamp.

2. The light emitting diode lamp according to claim 1, wherein the electrical input is a constant current input, and the angle between the first pair of side connecting pins is about one hundred and fifty degrees.

3. The light emitting diode lamp according to claim 1, wherein the electrical input is a constant voltage input, and the angle between the first pair of side connecting pins is about one hundred and sixty-five degrees.

4. The light emitting diode lamp according to claim 1, wherein the electrical input is an alternating current input, and the angle between the first pair of side connecting pins is about one hundred and eighty degrees.

5. The light emitting diode lamp according to claim 1, wherein the at least one LED of the one or more LEDs is a bi-color LED, and the light emitting diode lamp further comprises a second pair of side connecting pins.

6. The light emitting diode lamp according to claim 1, wherein the at least one LED of the one or more LEDs is a red, green, and blue (RGB) LED, and the light emitting diode lamp further comprises a second and a third pair of side connecting pins.

7. The light emitting diode lamp according to claim 1, wherein the first pair of side connecting pins is arranged such that each side connecting pin of the first pair of side connecting pins has a different polarity with respect to the other side connecting pin of the first pair of side connecting pins and wherein there is an insulating material surrounding each side connecting pin of the first pair of side connecting pins.

8. The light emitting diode lamp according to claim 1, wherein the light emitting diode lamp further comprises a printed circuit board (PCB), the PCB configured to connect each side connecting pin of the first pair of side connecting pins to the at least one LED of the one or more LEDs.

9. The light emitting diode lamp according to claim 8, wherein the PCB is further configured to regulate the electrical input to control the brightness and electrical power supplied to the at least one LED of the one or more LEDs.

10. The light emitting diode lamp according to claim 1, further comprising a heat sink; and wherein the light emitting diode lamp has an overall shape which includes the heat sink; and wherein the overall shape is cylindrical.

11. The light emitting diode lamp according to claim 10, wherein the heat sink has an outer diameter wherein the light emitting diode lamp has an outer diameter;

wherein the outer diameter of the the heat sink of the light emitting diode lamp is substantially the same as the outer diameter of the light emitting diode lamp.

12. The light emitting diode lamp according to claim 1, further comprising a reflector, and a lamp head cover.

13. The light emitting diode lamp according to claim 1, wherein each side connecting pin of the first pair of side connecting pins is positioned at an angle of at least thirty degrees from the other side connecting pin of the first pair of side connecting pins.

14. The light emitting diode lamp according to claim 1, further comprising a lens, and a lamp head cover.

15. A socket adapted for receiving a light emitting diode (LED) lamp partially therein, the socket comprising:

a base portion, the base portion adapted to secure at least one pair of side connecting pins of the light emitting diode LED lamp at a first angle as defined from a horizontal cross-sectional center of the base portion; and a top portion, the top portion adapted for receiving at least one pair of electrical wires, such that when the base portion and the top portion are connected, each of the at least one pair of side connecting pins electrically contacts an electrical wire and thereby provides an electrical input to the light emitting diode LED lamp.

16. The socket according to claim 15, wherein the electrical input is a constant current input, and the first angle is about one hundred and fifty degrees.

17. The socket according to claim 15, wherein the electrical input is a constant voltage input, and the first angle is about one hundred and sixty-five degrees.

18. The socket according to claim 15, wherein the electrical input is an alternating current input, and the first angle is about one hundred and eighty degrees.

19. The socket according to claim 15, wherein the at least one pair of electrical wires are arranged such that when connected, each electrical wire supplies electricity of a different polarity with respect to its adjacent electrical wires.

20. light emitting diode (LED) lamp system, the light emitting diode system comprising:

a socket adapted for receiving a light emitting diode (LED) lamp partially therein, the socket comprising:

a base portion, the base portion adapted to secure at least one pair of side connecting pins of the light emitting diode LED lamp at a first angle as defined from a horizontal cross-sectional center of the base portion; and a top portion, the top portion adapted for receiving at least one pair of electrical wires, such that when the base portion and the top portion are connected, each of the at least one pair of side connecting pins electrically contacts an electrical wire and thereby provides an electrical input to the light emitting diode LED lamp; and a light emitting diode (LED) lamp, comprising one or more LEDs;

a first pair of side connecting pins adapted to provide an electrical input to at least one LED of the one or more LEDs, the first pair of side connecting pins positioned at an angle from one another such that the angle between the first pair of side connecting pins is defined from a horizontal cross-sectional center of the light emitting diode lamp and the first pair of side connecting pins protrudes outwards from the light emitting diode lamp;

wherein the light emitting diode (LED) lamp is partially received in the socket such that electrical input provided by the at least one pair of electrical wires is supplied to the light emitting diode (LED) lamp by way of the first pair of side connecting pins.

* * * * *